US006478025B1

(12) United States Patent
Yort et al.

(10) Patent No.: US 6,478,025 B1
(45) **Date of Patent: *Nov. 12, 2002**

(54) FIREFIGHTING HOOD AND SCBA FACE MASK SYSTEM

(75) Inventors: Jerry D. Yort, Oklahoma City, OK (US); Michael Scott Tischer, Tecumseh, OK (US); Rick Allen Austin, Shawnee, OK (US)

(73) Assignee: Tayco

( * ) Notice: Subject to any disclaimer, the term of this patent is extended or adjusted under 35 U.S.C. 154(b) by 0 days.

This patent is subject to a terminal disclaimer.

(21) Appl. No.: 09/389,119

(22) Filed: Sep. 2, 1999

Related U.S. Application Data

(63) Continuation of application No. 08/821,099, filed on Mar. 20, 1997, now abandoned.

(51) Int. Cl.[7] ..... A62B 19/00

(52) U.S. Cl. ..... 128/201.25; 128/201.24; 128/206.24; 128/201.29

(58) Field of Search ..... 128/201.25, 206.23, 128/206.24, 201.29, 206.19, 205.21, 201.22, 201.23, 201.24, 202.24, 202.27, 205.25, 205.26, 206.14, 207.11

(56) References Cited

U.S. PATENT DOCUMENTS 2,414,405 A * 1/1947 Bierman et al. ..... 128/201.23
2,935,985 A * 11/1951 Andrews et al. ..... 128/201.23
2,587,958 A * 3/1952 Belloni ..... 128/201.23
3,943,571 A * 3/1976 Boatman ..... 128/201.23
4,174,710 A * 11/1979 Pampuch ..... 128/201.23
5,181,506 A * 1/1993 Tardiff et al. ..... 128/201.22
5,219,368 A * 6/1993 Page ..... 128/201.24
5,431,156 A * 7/1995 Sundstrom ..... 128/201.23
5,649,532 A * 7/1997 Griffiths ..... 128/206.24
5,653,225 A * 8/1997 Schegerin ..... 128/201.24
5,687,713 A * 11/1997 Bahr et al. ..... 128/201.28
6,006,360 A * 12/1999 Reed ..... 2/202
6,328,031 B1 * 12/2001 Tischer et al. ..... 128/201.22

* cited by examiner

*Primary Examiner*—Aaron J. Lewis
*Assistant Examiner*—Michael G. Mendoza
(74) *Attorney, Agent, or Firm*—Dunlap Codding & Roger Rogers, P.C.

(57) ABSTRACT

A protective headgear for a firefighter comprising a firefighting hood constructed from an aramid knit material, including a front opening for exposure of the firefighters face; an SCBA mask shaped to engage the firefighter's face; a fastening system for attaching the SCBA mask to the firefighting hood along the perimeter of the mask such that the front opening of the hood is positioned within the perimeter of the mask, assuring that at least the firefighter's mouth will be within the mask when worn; and a retainer attached to opposite sides of the mask and adapted to extend around the back of the firefighter's head such that the strap holds the mask snugly against the firefighter's face. Preferably, the fastening system attaches the mask to the firefighting hood at a plurality of points along the perimeter of the mask, such that when the hood and face mask system is donned by the firefighter, there is no skin exposed between the hood and the mask. Preferably, the retainer includes at least one elastic strap. Furthermore, the fastening system preferably releasably attaches the mask and straps to the hood along the perimeter such that the hood can be easily replaced if damaged, or washed if dirty.

4 Claims, 7 Drawing Sheets

FIREFIGHTING HOOD AND SCBA FACE MASK SYSTEM

This is a Continuation of application Ser. No. 08/821,099, filed Mar. 20, 1997, now abandoned.

BACKGROUND

The present invention relates to protective head gear for a firefighter, and more particularly, to a firefighting hood and SCBA face mask system which are combined into an integral unit.

In order to protect the sensitive head, face and neck areas of a firefighter which are not protected by the protective coat, helmet or face-mask, firefighters wear hoods that are shaped to cover the head, neck and shoulder regions and that include a front opening for exposure of the firefighters face. Such hoods serve to eliminate the possibility of a gap in the protection around the neck, cheeks and ears, between the helmet, face mask and coat collar of the firefighters.

Firefighting hoods are constructed of a fire-retardant, thermal-barrier material, such as a knit aramid polymer material (e.g., NOMEX, a trademark of E. I. DuPont de Nemours and Company, Inc.) to protect a firefighter against burns in the region covered by the hood. Typically, such fire fighter hoods are made of two layers of knitted or woven aramid fabric material.

In such hazardous firefighting environments, protection is needed not only from head impacts and heat, but also from breathing hazards such as smoke and noxious fumes. In order to be protected from all hazards, it may be necessary at times to wear a breathing mask, which is part of a self-contained breathing apparatus ("SCBA") system, in combination with the protective firefighting hood.

Conventionally, the firefighter will be wearing a firefighting hood and helmet, without the SCBA mask, upon arriving at the scene of a fire. As is sometimes the case, the firefighter may need to enter into a burning structure in the course of a firefighting or rescue operation; and prior to doing so, the firefighter must don the SCBA mask. To do this, the firefighter will first remove the firefighting helmet and then pull the portion of the firefighting hood covering his or her head down to around his or her neck, such that the head is exposed. Next, the firefighter will don the SCBA mask having a plurality of straps that create a harness for supporting the mask to the firefighter's head. When the mask is placed on the firefighters head, each of the straps making up the harness will need to be independently tightened so as to provide a snug fit on the firefighter's head. The hood will then be pulled up and back over the firefighters head and over the straps of the SCBA mask. And finally, the firefighting helmet will be re-donned over the SCBA mask and hood.

This arrangement and method has several disadvantages. One disadvantage is that the individual straps of the SCBA mask must all be adjusted to secure the SCBA mask snugly against the firefighter's head; thus wasting valuable time. Another disadvantage is that the straps of the SCBA mask tend to become very uncomfortable, especially in hot environments where the firefighter has been vigorously exerting himself or herself for a number of hours. Another disadvantage is that once the SCBA mask is securely donned to the firefighters head, and when the firefighter is attempting to pull the firefighting hood back over the straps and buckles of the mask's harness, it is very difficult for the firefighter to cover the straps and buckles of the mask so as not to leave open portions of skin exposed. This is especially difficult at the scene of a fire when time is of the essence and when there is seldom another person available to assist in the donning of the hood over the mask. Therefore, the firefighter is at risk of having exposed portions of his or her head in the high heat and flame environment.

Yet another disadvantage of the above prior-art SCBA mask donning method, is that after donning the SCBA mask and its bulky harness, the firefighter is required to re-size the firefighting helmet prior to re-donning; thus wasting even more time.

Accordingly, a need exists for a firefighting hood and SCBA face mask system that greatly simplifies and speeds the donning of the SCBA mask, is comfortable to wear in the high heat environment, and that does not put the firefighter at risk of having portions of his or her head exposed in these high heat or flame environments.

SUMMARY OF THE INVENTION

The present invention is a protective headgear for a firefighter comprising a firefighting hood constructed from a heat and flame resistant, aramid knit or woven material, including a head portion shaped to enclose the firefighter's head and a front opening for exposure of at least the firefighter's mouth; an SCBA mask shaped to engage the firefighters face and having a perimeter; a fastening system for attaching the SCBA mask to the firefighting hood along the perimeter of the mask such that the front opening of the hood is positioned within the perimeter of the mask, assuring that at least the firefighter's mouth will be within the mask when worm; and a retainer attached to opposite sides of the mask and adapted to extend around the back of the firefighter's head and hold the mask snugly against the firefighter's face. Preferably the retainer includes at least one elastic strap. But the retainer can also include an adjustable strap, elastic yam woven into the hood material, the hood itself sized to snugly fit over the wearers head, the original SCBA mask straps, etc.

Preferably, the fastening system attaches the mask to the firefighting hood at a plurality of points along the perimeter of the mask, such that when the hood and face mask system is donned by the firefighter, there is no skin exposed between the hood and the mask. Furthermore, the fastening system preferably releasably attaches the mask and straps to the hood along the perimeter such that the hood can be replaced if damaged, or washed if dirty.

The firefighting hood also preferably includes a bib portion extending downward from the neck portion of the hood and adapted to be worn over the collar and front closure of the firefighting jacket, to block the entrance of burning embers or fluids between the neck and collar of the firefighting jacket. The bib portion can also be tucked into the collar and firefighting jacket if desired.

Accordingly, to don the SCBA mask and integrated hood system of the present invention, all that the firefighter needs to do is remove his or her helmet and then slip the hood and mask system over his or her head. The helmet can then be re-donned on the firefighter's head without having to readjust the size of the helmet. This is because the elastic straps add very little to the size of the firefighter's head. Further, the absence of the bulky straps and buckles of the conventional SCBA mask allows the present invention to be much more comfortable to the firefighter, and also eliminates the time required to adjust the individual straps of the conventional SCBA to provide a proper fit. Furthermore, because the mask and hood are attached along the perimeter of the mask at a plurality of points, there are no gaps between the hood and the mask in which burning embers or other unwanted elements can enter through.

Accordingly, it is an object of the present invention to provide a protective head gear for a firefighter which is easy and quick to don, comfortable to wear, and which provides the protection of a firefighting hood and an SCBA mask. Furthermore, it is an object of the present invention to virtually eliminate the risk of having exposed portions of the firefighter's face when an SCBA mask has been donned at the scene of a fire. Of course, other objects and advantages of the present invention will be apparent from the following description, the accompanying drawings and the appended claims.

DETAILED DESCRIPTION

Figure 1:
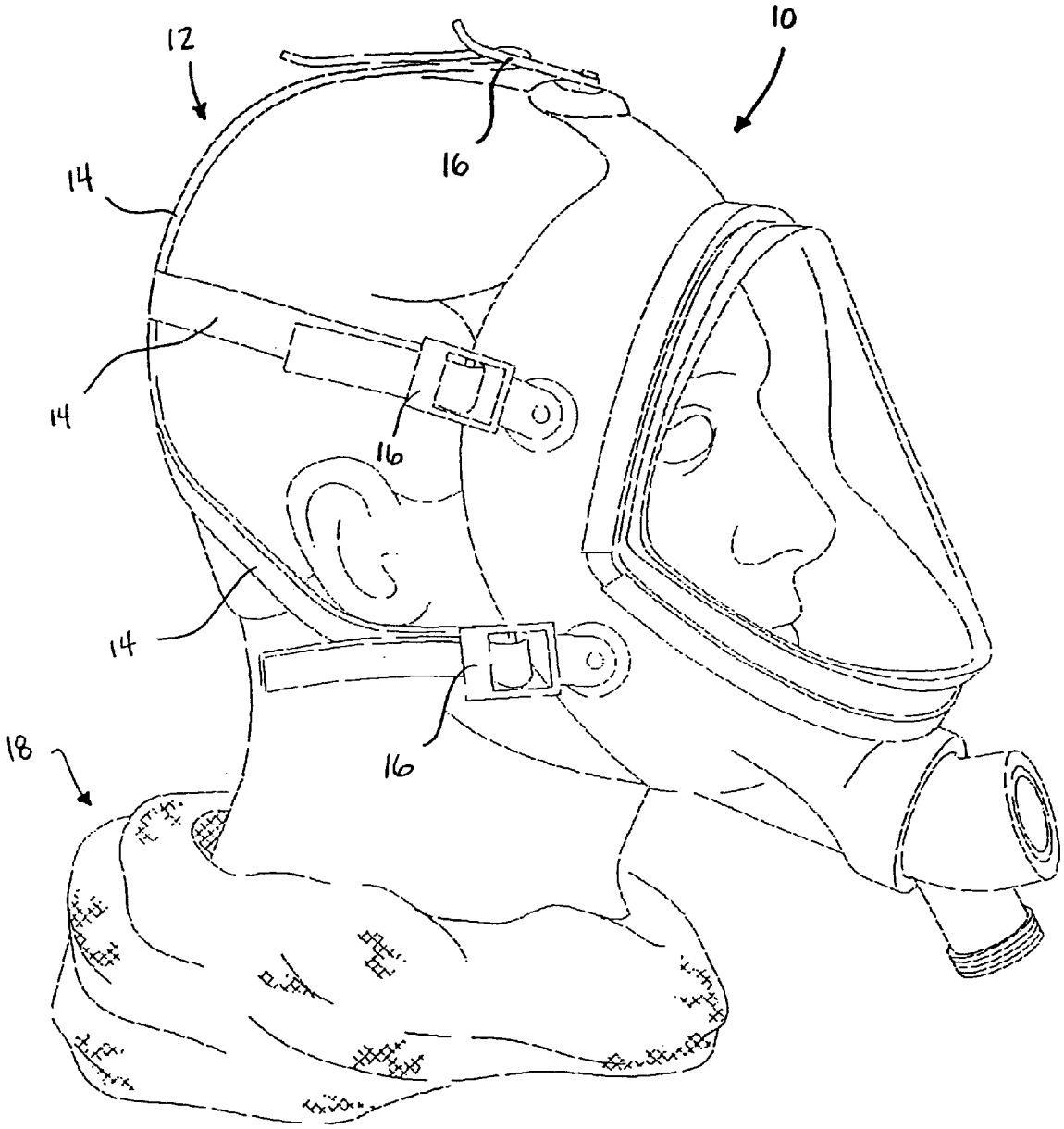
FIG. 1 PRIOR ART
FIG. 1 is a perspective view of a prior-art SCBA mask worn on a firefighter's head.

As shown in FIG. 1, a conventional prior art SCBA mask 10 will include a harness 12, having a plurality of straps 14 for securing the SCBA mask snugly onto the firefighter's head. Each of the straps 14 will need to be independently tightened or adjusted using the adjustable buckles. 16. Prior to donning the SCBA mask 10, the firefighter must first pull down the portion of the conventional firefighting hood 18 covering the head of the firefighter, to his or her neck such that the head is exposed.

Figure 2:
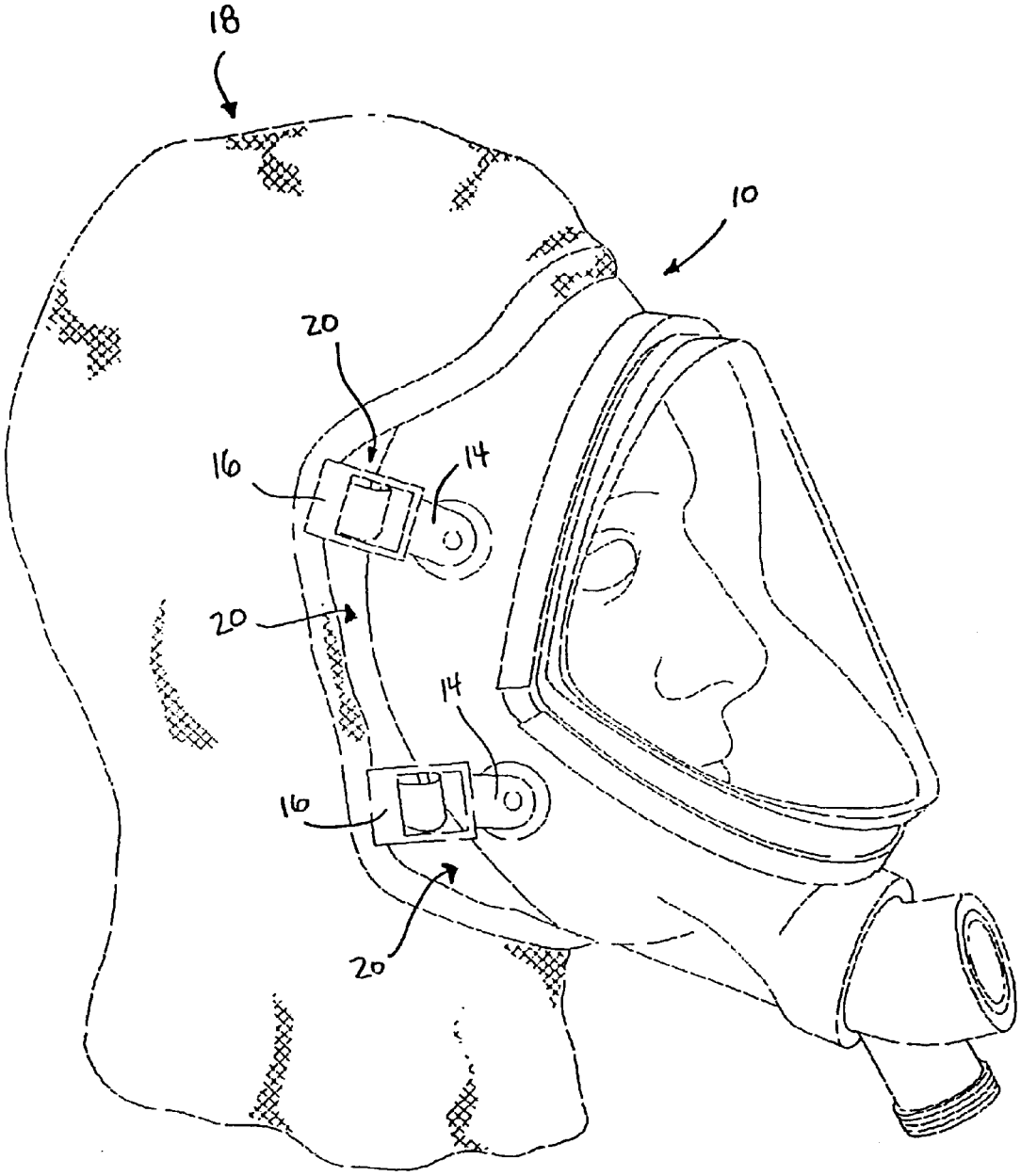
FIG. 2 PRIOR ART
FIG. 2 is a perspective view of a prior-art SCBA mask and a prior-art firefighting hood worn on a firefighter's head.

As shown in FIG. 2, when the conventional firefighting hood 18 is pulled back over the firefighters head, the buckles 16 of the adjustable straps 14 may catch on the hood 18. Therefore, because the firefighter may be operating in haste, the firefighter may not notice, or may not have time to check, whether exposed areas of skin 20 remain between the SCBA mask 10 and the firefighting hood due to the hood 18 catching upon the buckles 16.

Figure 3:
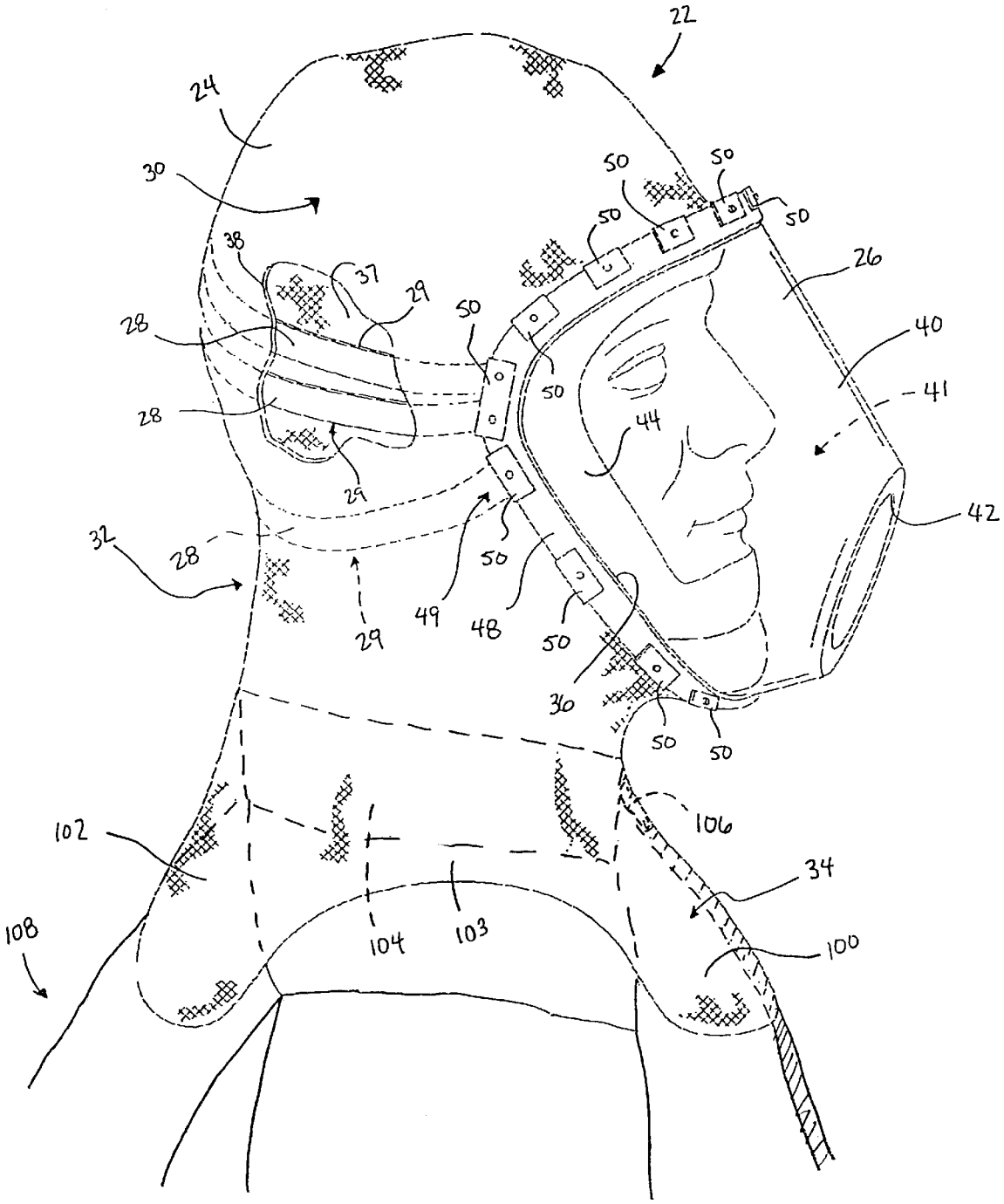
FIG. 3 is a perspective view of the present invention, with a portion cut away to show the elastic straps.

As shown in FIG. 3, an embodiment of the integrated firefighting hood and SCBA face mask system of the present invention 22 comprises a firefighting hood component 24, an SCBA mask component 26 and at least one elastic strap component 28. The firefighting hood component 24 is shaped to enclose the head of the firefighter. Therefore, the hood component 24 includes a head portion 30 shaped to cover the forehead, ears and chin of the firefighter; a neck portion 32 shaped to cover the neck of the firefighter; and an optional annular bib portion 34. The bib portion 34 includes a front, downwardly extending flap or lobe 100, a rear downwardly extending flap or lobe 102, and a pair of side flanges 103 shorter than the front and rear flaps. Thus, the bib portion 34 is shaped and sized to completely cover the collar 104 and to cover an upper portion of the closure 106 of the firefighter's jacket 108, such that fluids and embers are prevented from entering between the neck of the firefighter and the collar of the firefighters jacket. The shorter side flanges allow for fitting the bib portion over the shoulders of the firefighter.

The head portion 30 includes a front opening 36 for exposure of the firefighter's eyes, nose and mouth. The head portion 30 is made of inner and outer layers 37 and 38 of a heat and flame resistant aramid knit or woven material, respectively, which are coextensive over the head portion 30 (see also FIG. 4). And preferably, the entire hood 10 is made of a flame and heat resistant knit material. Examples of heat and flame resistant knit materials for use with the present invention include an aramid polymer material such as NOMEX®, a polybenzamidazole ("PBI") fiber, an aramid polymer fiber such as KEVLAR®, or a combination or blend of any of these or similar materials. NOMEX® and KEVLAR® are trademarks of E. I. DuPont de Nemours and Company, Inc.

The SCBA mask component 26 includes a clear plastic face-plate 40 having a channel or aperture 42 for providing fluid communication between the interior breathing chamber 41 of the mask and an air hose (not shown) of a breathing apparatus. The faceplate 40 is preferably shaped to provide a breathing chamber 41 between the firefighter's face and the faceplate. A cushioned gasket 44, ergonomically shaped to conform to and abut against the frontal portion of the firefighter's head and/or face, is mounted to the interior of the SCBA mask. This gasket 44 provides comfort to the firefighter's face when the hood and facemask system 22 is worn and also acts to seal the breathing chamber 41 from the outside environment.

The SCBA mask component 26 also includes a rim 48 extending around the perimeter of the mask. As will be described below, the rim 48 preferably acts as an attachment point for the gasket 44, the faceplate 40 and the head portion 30 of the hood.

Figure 4:
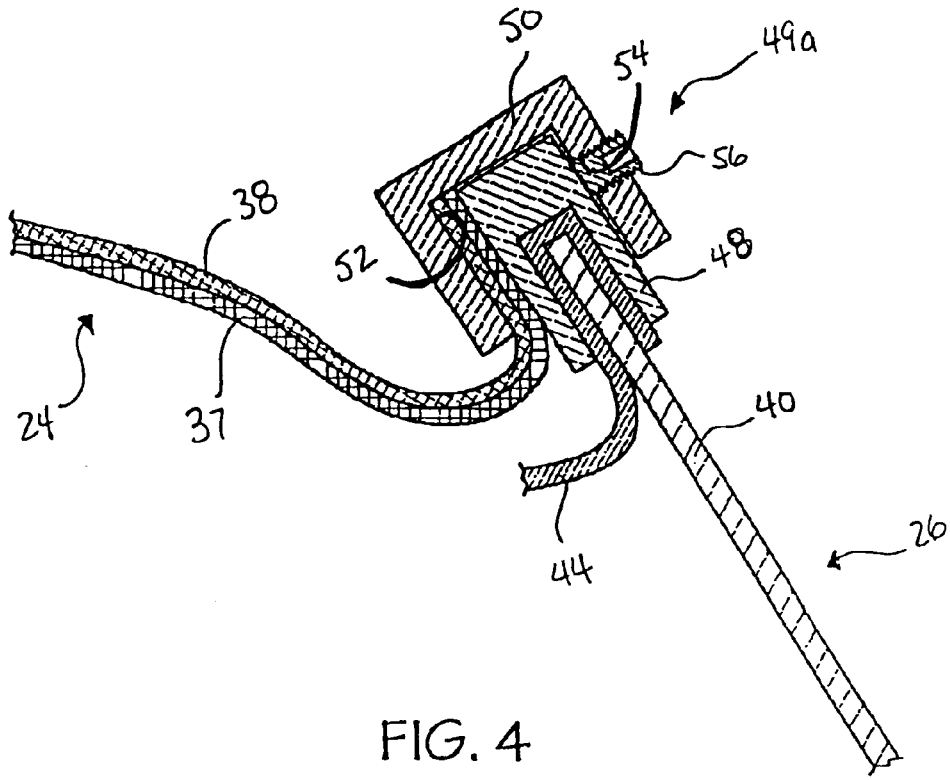
FIG. 4 is a cross-sectional view of a fastener system for use with an embodiment of the present invention.

As shown in FIG. 4, the rim 48 acts as a clamp to clamp the elastic cushion material of the gasket 44 over the face plate 40, and in turn, to mount the gasket 44 to the face plate 40.

Referring to FIGS. 3 and 4, the rim 48, and in turn the entire SCBA mask component 26, is attached to the head portion of the hood 30 along the opening 36 of the hood by a fastening system 49. The fastening system attaches the head portion of the hood 30 to the rim 48 at a plurality of points therealong, such that when the hood and the face mask system 22 is donned by the wearer, there is no skin exposed between the hood component 24 and the mask component 26.

In one embodiment of the present invention, the fastening system 49*a* includes a plurality of releasable clamps 50. As shown in FIG. 4, each of the releasable clamps 50 has a cross-sectional U-shape such that the rim 48 and such that the two layers of hood material 37, 38 can be received within the groove 52 formed by the clamp. The clamp includes a threaded hole 54 extending through the side of the clamp such that a threaded bolt 56 can be screwed through the side of the clamp and into the channel 52. Therefore, upon tightening the screw 56 the rim 48 and the material layers of the hood 37, 38, will be locked within the channel 52 of the clamp 50, thereby releasably attaching the hood component 24 to the SCBA mask component 26.

As shown in FIG. 3, an embodiment of the protective head gear system 22 also includes a retainer, shown as a plurality of elastic straps 28 releasably attached to the rim 48 of the SCBA mask component 26 at opposite sides of the rim by the clamps 50. The free portions 29 of the straps 28 extend around the back of the firefighter's head to hold the SCBA mask component 26 snug against the firefighter's head or face. The free portions 29 of the straps 28 preferably extend between the inner and outer material layers 37 and 38, respectively, of the head portion 30 of the hood 24; and the free portions 29 of the straps 28 may also be stitched to the material layers 37, 38 of the hood to assure that their positions with respect to the head remain constant when the head gear system 22 is worn.

As should be apparent to one of ordinary skill in the art, it is within the scope of the present invention to include alternate types of retainers, such as resilient or tightenable components, to hold the SCBA mask component 26 snug against the firefighter's head or face. For example, it is within the scope of the present invention to weave elastic yam or thread into the material of the hood component 24, thus giving the entire hood portion an resilience that will hold the SCBA mask component 26 snug against the firefighter's head or face. It is within the scope of the invention to provide adjustable straps, pull-threads, adjustment flaps, or the like, in place of the elastic straps 28 or the elastic weave; and it is also within the scope of the invention to size the head portion of the hood such that it fits tightly around the wearers head, thus causing the mask to be held snug against the wearers face. Furthermore, it is within the scope of the invention to use the original harness system of the SCBA mask (an example of which is shown in FIG. 1) as the retainer, attaching the head portion 30 to the rim 48 of the SCBA mask by one of the fastening systems described herein, and extending the head portion 30 of the hood over the harness system of the SCBA mask.

Figure 5:
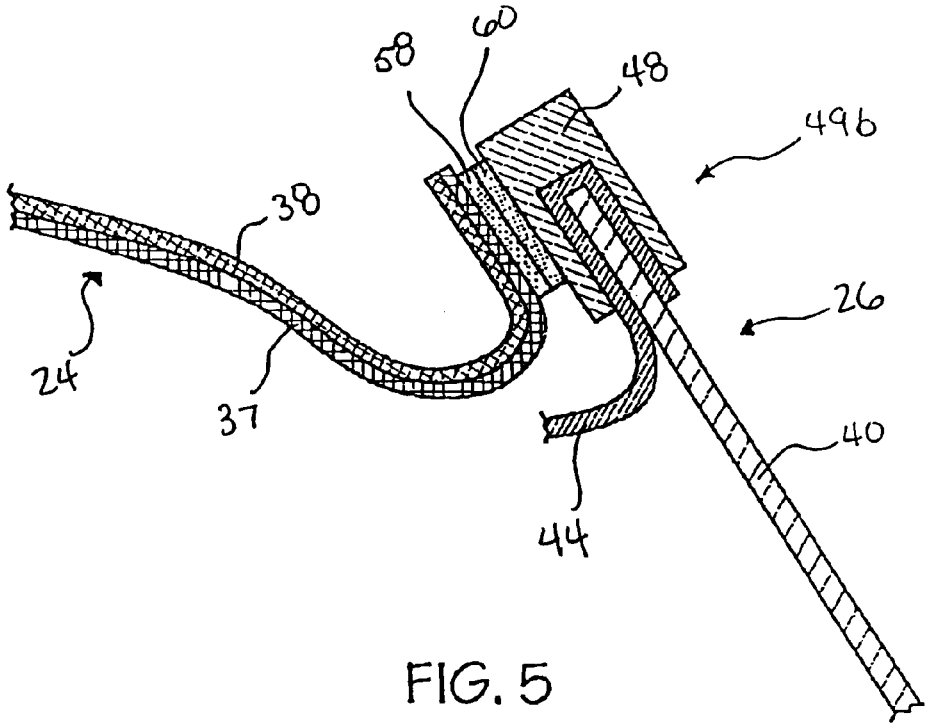
FIG. 5 is a cross-sectional view of an alternate fastener system for use with an embodiment of the present invention.

As shown in FIG. 5, an alternate design for the fastening system 49*b* of the present invention provides strips of hook and pile material in place of the plurality of clamps 50 to releasably attach the hood component 24 to the SCBA mask component 26. A plurality of patches of loop material 58 are stitched to the two layers of hood material 37, 38. These mate with a corresponding plurality of patches of pile material 60 bonded to the rim 48 of the SCBA mask component. Of course, it will be apparent to one of ordinary skill in the art that the arrangement of the loop material 58 and pile material 60 can be interchanged with respect to the hood material and the SCBA mask.

Figure 6:
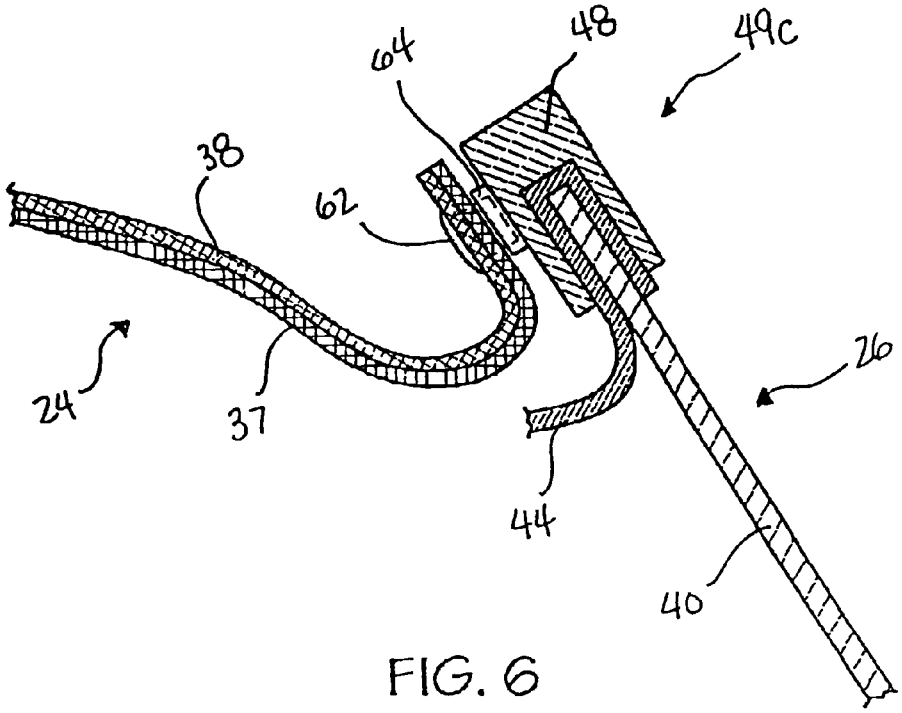
FIG. 6 is a cross-sectional view of another alternate fastener system for use with an embodiment of the present invention.

As shown in FIG. 6, another alternate design for the fastening system 49*c* of the present invention provides a plurality of snaps in place of the plurality of clamps 50 to releasably attach the hood component 24 to the SCBA mask component 26. A plurality of male snap components 62 are crimped, or otherwise fastened, to the two layers of hood material 37, 38. These mate with a corresponding plurality of female snap components 64 bonded to the rim 48 of the SCBA mask component. Of course, it will be apparent to one of ordinary skill in the art that the arrangement of the male snap components 62 and the female snap components 64 can be interchanged with respect to the hood material and the SCBA mask.

Figure 7:
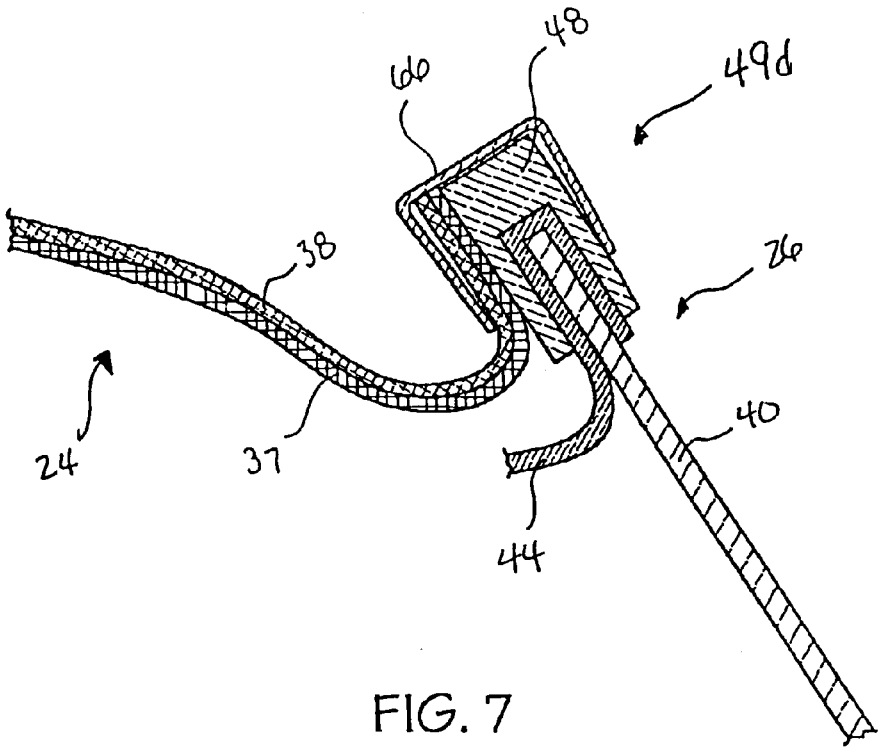
FIG. 7 is a cross-sectional view of another alternate fastener system for use with an embodiment of the present invention.

As shown in FIG. 7, another alternate design for the fasting system 49*d* of the present invention replaces the plurality of clamps 50 with a plurality of spring-steel, self locking clamps 66.

Figure 8:
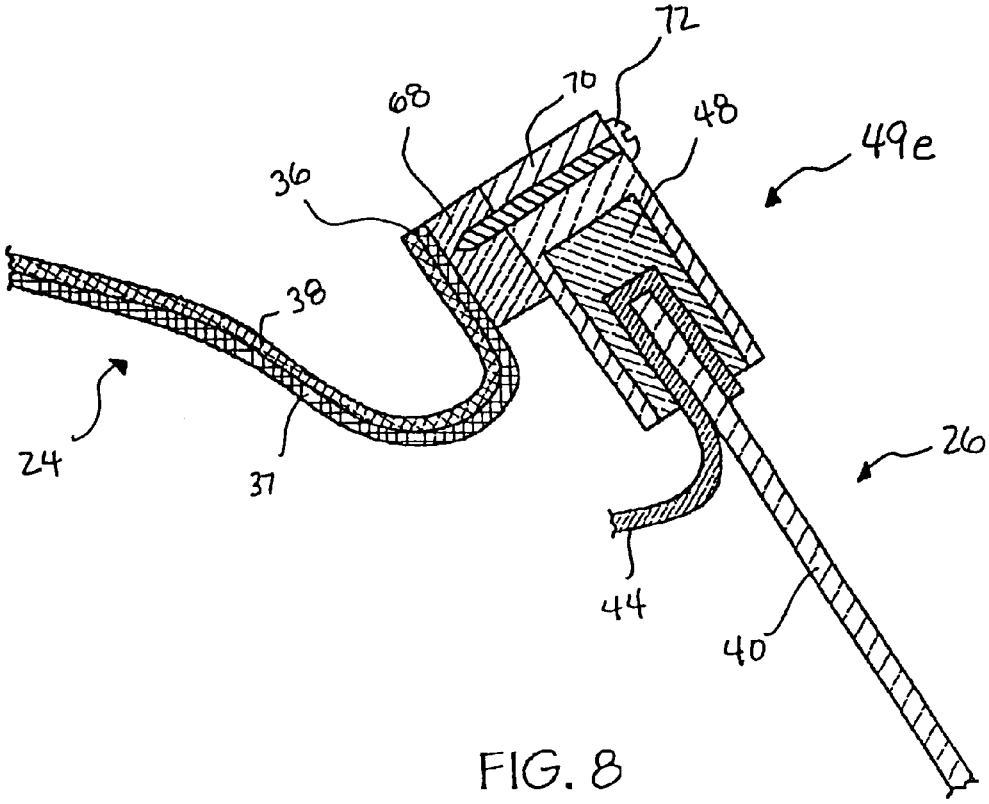
FIG. 8 is a cross-sectional view of another alternate fastener system for use with an embodiment of the present invention.

As shown in FIG. 8, another alternate design for the fastening system 49*e* of the present invention provides a molded plastic frame 68 bonded or stitched to the opening 36 of the head portion of the hood. The SCBA mask component 26 includes a matching molded plastic frame 70 bonded to the rim 48. These matching frames 68, 70 are coupled to each other using set screws 72.

Figure 9:
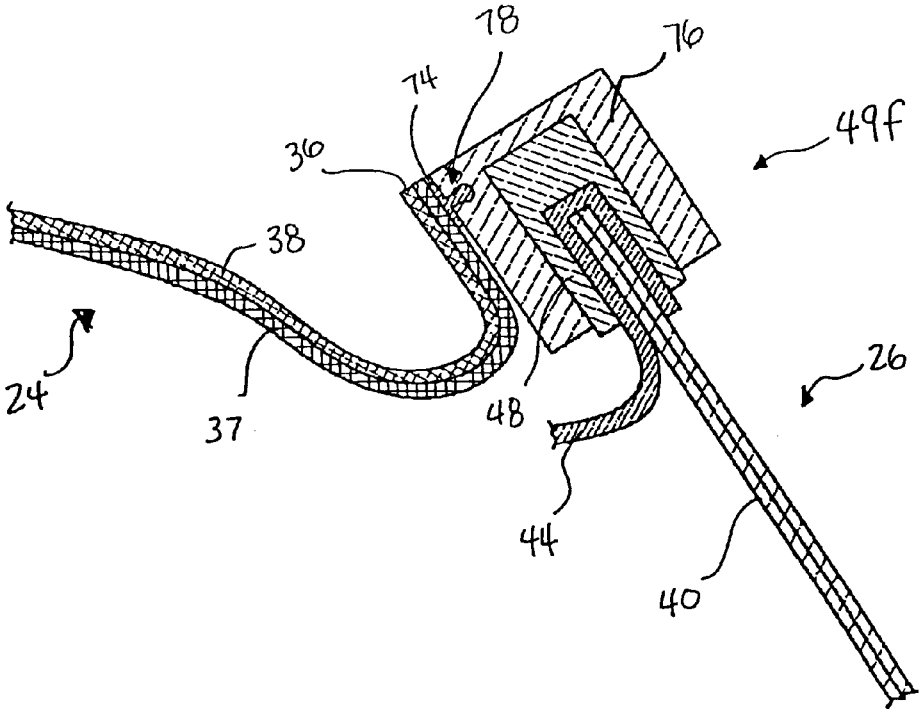
FIG. 9 is a cross-sectional view of another alternate fastener system for use with an embodiment of the present invention.

As shown in FIG. 9, another alternate design for the fastening system 49*f* of the present invention provides a molded plastic frame 74 bonded or stitched to the opening 36 of the head portion of the hood. The SCBA mask component 26 includes a matching molded plastic frame 76 bonded to the rim 48. These matching frames 74, 76 are coupled to each other using bead and groove fastener 78 in place of the plurality of set screws 72 as described above. Examples of bead and groove fasteners for use with the present invention include any MAXIGRIP®, ARROWLOCK®, U-MAXIGRIP®, or ULTRASEAL® closure systems commercially available from ITW Maxigrip, Somerset, N.J.

Figure 10:
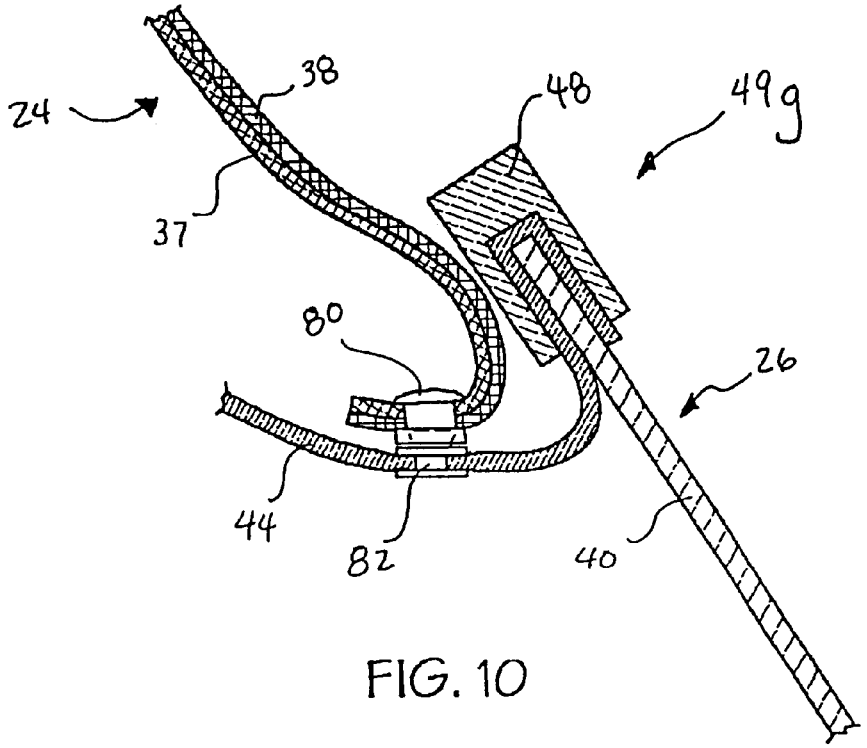
FIG. 10 is a cross-sectional view of another alternate fastener system for use with an embodiment of the present invention.

As shown in FIG. 10, in another alternate design for the fastening system 49*g* of the present invention a plurality of female snap components 80 are crimped, or otherwise fastened, to the two layers of hood material 37, 38. These mate with a corresponding plurality of male snap components 82 crimped, or otherwise fastened to the gasket 44 of the SCBA mask component. Of course, it will be apparent to one of ordinary skill in the art that the arrangement of the female snap components 80 and the male snap components 82 can be interchanged with respect to the hood material and the SCBA mask.

Figure 11:
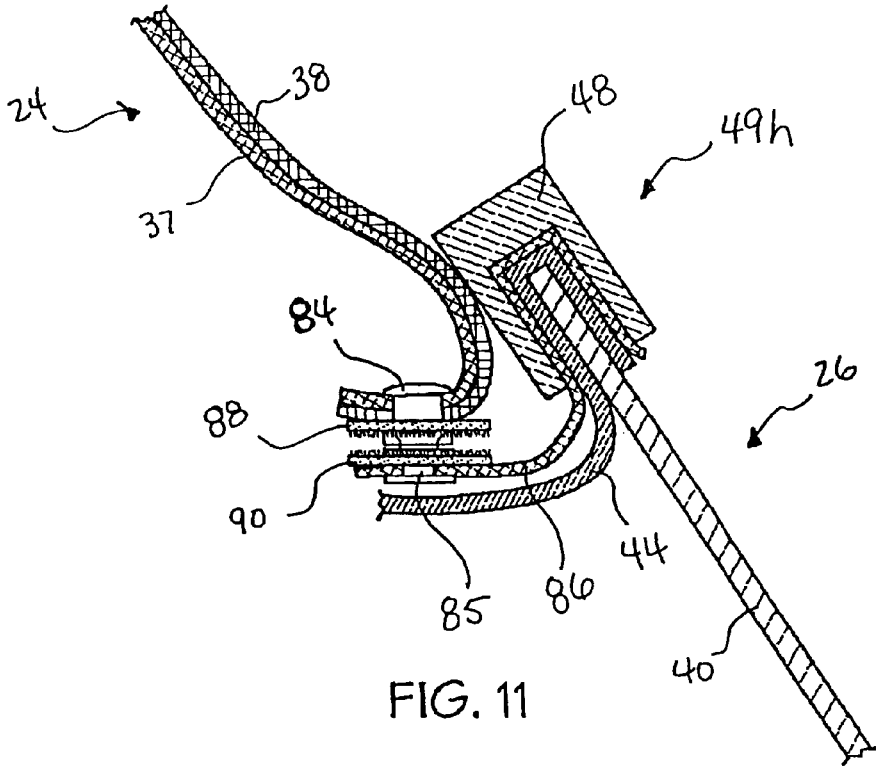
FIG. 11 is a cross-sectional view of another alternate fastener system for use with an embodiment of the present invention.

As shown in FIG. 11, in another alternate design for the fastening system 49*h* of the present invention, a plurality of female snap components 84 are crimped, or otherwise fastened, to the two layers of hood material 37, 38. These mate with a corresponding plurality of male snap components 85 crimped, or otherwise fastened to a harness 86 which is, in turn, clamped to the SCBA mask by the rim 48. Mating patches of hook and pile material 88, 90 are respectively sewn or bonded to the hood material 37, 38 and to the harness 86 to provide additional closure between the hood and SCBA mask.

At this point it should be apparent to one of ordinary skill in the art that it is within the scope of the present invention to utilize any one of, or a combination of, the above or similar fastening systems for attaching the SCBA mask component 26 to the hood component 24, such as stitching, epoxy, slide-fasteners, buttons, etc. As is further discussed above, it is preferred that the fastening system attach the head portion of the hood 30 to the rim 48 of the mask at a plurality of points therealong such that when the hood and the face mask system 22 is donned by the wearer, there is no skin exposed between the hood component 24 and the mask component 26; and further it is preferred that the fastening system releasably attach the hood to the mask. It will also be apparent to one of ordinary skill in the art that the straps 28 can be releasably attached to the SCBA mask 26 by any of the fastening systems, or any similar systems, discussed above.

To don the SCBA mask and integrated hood system 22 of the present invention, the firefighter will first remove his or her helmet; will then slip the SCBA mask and integrated hood system 22 over his or her head, pulling the bib portion 34 downward over the collar and closure of the firefighting jacket; and will then re-don the firefighting helmet, often without having to re-adjust the fit of the helmet.

In conclusion, the present invention is a protective headgear for a firefighter which satisfies the performance requirements of an SCBA mask and a firefighting hood, yet which is much quicker to don than conventional systems, which is more comfortable than conventional systems, and which is safer than conventional systems. Having described the invention in detail and by reference to the drawings, it will be apparent that modification and variations are possible without departing from the scope of the invention as defined in the following claims.

What is claimed is:

1. An apparatus for protecting an individual from elements associated with a firefighting site, comprising:

a face mask comprising:

an annular rim;

a seal member secured to the annular rim and adapted for sealing engagement with the individual's face; and a face plate extending across the annular rim providing visibility to the individual and cooperating with the annular rim and the seal member to form a breathing chamber when the seal member is in sealing engagement with the individual's face;

a firefighting hood constructed of a flexible, fire resistant material and configured to be extendible over the head of the individual, the firefighting hood having a face opening for exposing the individual's face to the breathing chamber of the face mask, the face opening defined by an annular edge, the annular edge of the firefighting hood positioned against the face mask in an overlapping relationship; and connecting means secured to at least a portion of each of the firefighting hood and the face mask for detachably connecting the firefighting hood to the face mask so as to secure the annular edge of the firefighting hood to the face mask in the overlapping relationship to prevent exposure of the individual's head to the high heat environment associated with a firefighting site.

2. The apparatus of claim 1 wherein the firefighting hood further comprises:

at least one strap having a first end attached to the firefighting hood near one portion of the connecting means and a second end attached to the firefighting hood near a second portion of the connecting means, the strap extending around a portion of the firefighting hood for holding the face mask snugly against the individual's face.

3. An apparatus for protecting an individual from elements associated with a firefighting site, comprising:

a face mask comprising:

an annular rim;

a seal member secured to the annular rim and adapted for sealing engagement with the individual's face; and a face plate extending across the annular rim providing visibility to the individual and cooperating with the annular rim and the seal member to form a breathing chamber when the seal member is in sealing engagement with the individual's face;

a firefighting hood constructed of a flexible, fire resistant material and configured to be extendible over the head of the individual, the firefighting hood having a face opening for exposing the individual's face to the breathing chamber of the face mask, the face opening defined by an annular edge, the annular edge of the firefighting hood positioned against the face mask in an overlapping relationship;

a plurality of first connector members secured to the firefighting hood adjacent the annular edge of the firefighting hood; and a plurality of second connector members secured to the face mask such that each of the second connector members is detachably connected to a corresponding one of the first connector members so as to detachably connect the annular edge of the firefighting hood to the face mask in the overlapping relationship to prevent exposure of the individual's head to the high heat environment associated with a firefighting site.

4. The apparatus of claim 3 wherein the firefighting hood further comprises:

at least one strap having a first end attached to the firefighting hood near one of the first connector members and a second end attached to the firefighting hood near another one of the first connector members, the strap extending around a portion of the firefighting hood for holding the face mask snugly against the individual's face.

* * * * *